US008196415B2

(12) United States Patent
Veprik

(10) Patent No.: US 8,196,415 B2
(45) Date of Patent: Jun. 12, 2012

(54) CLOSED CYCLE STIRLING CRYOGENIC COOLER WITH COLD PLASMA PRESSURE WAVE GENERATOR

(75) Inventor: Alex Veprik, Kiryat Bialik (IL)

(73) Assignee: Ricor Ltd., En-Harod Ihud (IL)

( * ) Notice: Subject to any disclaimer, the term of this patent is extended or adjusted under 35 U.S.C. 154(b) by 716 days.

(21) Appl. No.: 12/360,262

(22) Filed: Jan. 27, 2009

(65) Prior Publication Data

US 2010/0186425 A1 Jul. 29, 2010

(51) Int. Cl.
*F25B 9/00* (2006.01)

(52) U.S. Cl. ..... 62/6; 60/516; 60/517; 60/518; 60/519; 60/520; 60/537

(58) Field of Classification Search .. 62/6; 60/516–520, 60/537
See application file for complete search history.

(56) References Cited

U.S. PATENT DOCUMENTS 3,977,191 A * 8/1976 Britt ..... 60/509
5,694,773 A * 12/1997 Hatanaka ..... 60/516
6,669,454 B2 * 12/2003 Lal et al. ..... 417/410.2

* cited by examiner

*Primary Examiner* — Cheryl J Tyler
*Assistant Examiner* — Orlando E Aviles Bosques
(74) *Attorney, Agent, or Firm* — Dekel Patent Ltd; David Klein

(57) ABSTRACT

A closed cycle Stirling cryogenic cooler, typically utilizing a noble gas (He or like) as a working fluid and containing a pneumatically driven expander interconnected with a low frequency pressure wave generator using a flexible transfer line or conduit, wherein the pressure wave generator includes a sealed gas discharge cavity containing the pressurized working fluid and a plurality of discharge electrodes which are electrically isolated, protrude through the walls of the cavity and are electrically connected to the high frequency pulse voltage supply, thus producing the glow discharge resulting in a cloud of cold plasma, making a so-called "plasmanized gas piston".

5 Claims, 3 Drawing Sheets

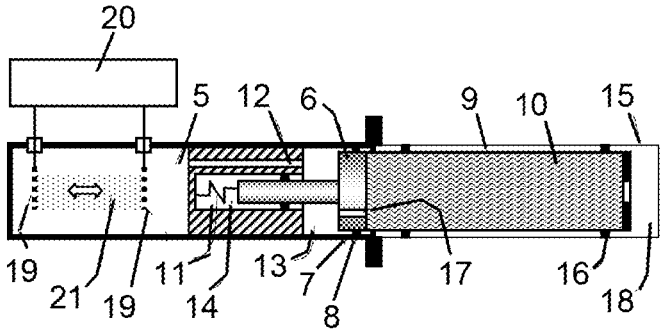
FIG. 2A
FIG. 2B
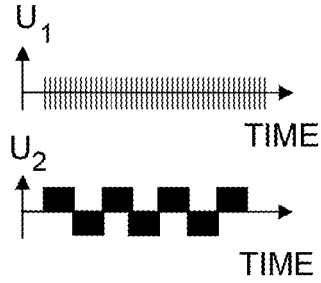
FIG. 2C

FIG. 3A
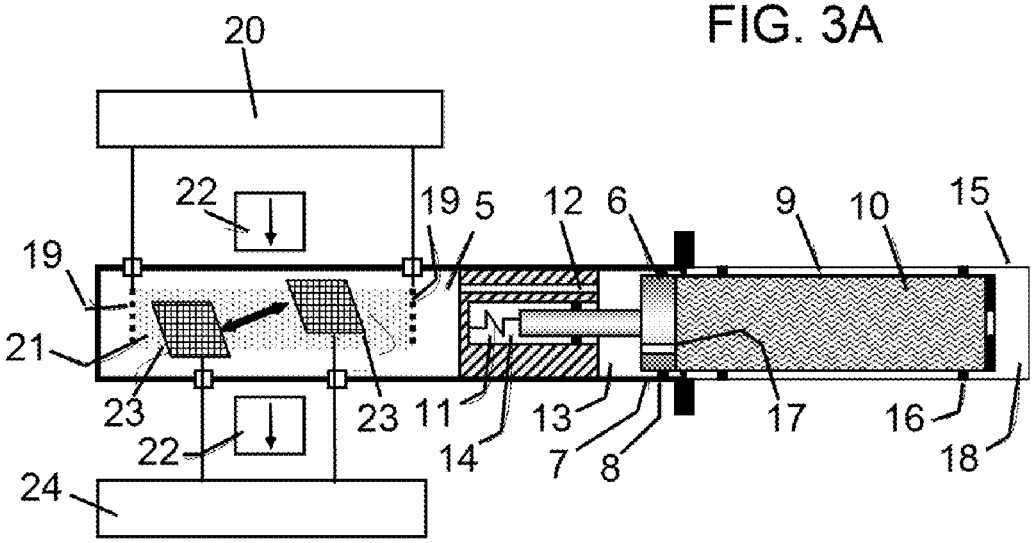
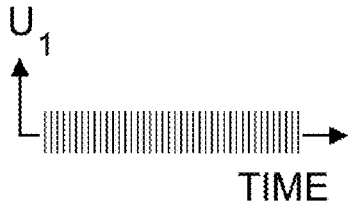
FIG. 3B
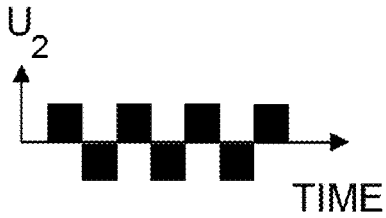
FIG. 3C

CLOSED CYCLE STIRLING CRYOGENIC COOLER WITH COLD PLASMA PRESSURE WAVE GENERATOR

FIELD OF THE INVENTION

The present invention relates to closed cycle Stirling cryogenic coolers.

BACKGROUND OF THE INVENTION

Closed cycle Stirling cryogenic coolers (refrigerators) are well known and used widely to maintain various electronic devices and systems at cryogenic temperatures. Infrared sensors, demagnetization devices, infrared interferometers, cryogenically cooled optics, filters and low-noise cryogenic electronic devices are representative electronic components requiring cryogenic cooling. Such refrigerators typically comprise expanders interconnected to a pressure wave generator using a transfer line or conduit.

The expander portion of such a cooler typically comprises a movable displacer-regenerator which is supported inside a cold finger housing using an appropriate arrangement of pneumatic and mechanical springs forming a vibratory system with properties to resonate with the desired stroke and optimal phase lag relative to the pressure oscillation arriving from the pressure wave generator, thus shuttling the working agent (typically helium) back and forth from the cold side to the hot side of the cold finger portion of the expander, as needed for producing a useful cooling effect, as explained, for example, in G. Walker, "Cryogenic Coolers, Part 2—Applications", Plenum Press, New York, 1983.

The purpose of a pressure wave generator, therefore, is to produce low frequency oscillatory pressure pulses and volumetric changes of a working agent inside a hot space of the expander which are used for actuating the movable regenerator-displacer assembly and for supplying pressurised gas to the expansion space of the cold finger.

In a piston pressure wave generator, the low frequency pressure waves are produced by a piston reciprocating inside a tightly matched cylinder sleeve, where the separation of the compression space, for the sake of reliability, normally relies on a dynamic clearance seal. The piston is driven by a rotary drive through a crank-slider arrangement or directly using a linear voice coil motor, such as of a "moving magnet" or "moving coil" design, as described for example in U.S. Pat. Nos. 5,596,875, 4,365,982 and 6,094,912.

The known disadvantages of the above pressure wave generators include large bulk (size and weight), and typically low performance of electromechanical driving and gas compression. Furthermore, such a pressure wave generator cannot deliver high compression ratios, due to the inherently large dead volumes and parasitic back-flows through the dynamic clearance seals. In addition, the life span is limited because of friction and wear. Other disadvantages are the noise and vibration produced by the imbalance, and micro-collisions occurring between the moving components.

Also known are membrane pressure wave generators, comprising a linear motor of voice coil, electromagnetic or solenoid type driving a compliant diaphragm which is attached to a rigid compression chamber, as described for example in U.S. Pat. No. 5,645,407. The known disadvantages of such an approach are low reliability, low performance of electromechanical driving, mechanical complexity and high bulk and inherently large dead volume that prevent developing high compression ratios.

Another known generator is an acoustic pressure wave generator (sonic compressor), in which large pressure oscillations are obtained by acoustic resonant amplification of relatively weak acoustic waves produced by a loudspeaker inside an optimally shaped gas chamber, as described for example in U.S. Pat. Nos. 5,231,337, 5,174,130, 5,263,341 and 5,020,977, amongst others. The disadvantage of such an approach is that a relatively bulky gas chamber is needed to support a desirable low frequency resonance. Further disadvantages are low performance of electromechanical driving and the sensitivity of the low frequency resonance to the ambient temperature.

Also known are low frequency pressure wave generators that operate thermoacoustically, as described for example in U.S. Pat. Nos. 4,953,366 and 5,901,556. Such a device typically comprises an internally heated gas cavity with an attached resonant tube or cavity. Development of low frequency intensive gas compression waves relies on thermoacoustic instability in a Helmholtz resonator with non-uniformly heated walls, and manifests itself in the form of self-sustained oscillations synchronized with the natural acoustic resonance. Disadvantage of such an approach are extremely low performance and a relatively bulky gas chamber is needed to support a desirable low frequency resonance.

Pumps are also known for transporting gases, vapours and liquids having a tubular shape and accommodating electrodes electrically connected to a pulsed electrical power supply, and having check valves means mounted in the inlet and outlet sections of the pump. Such pumps are described for example in U.S. Pat. Nos. 2,050,391 and 3,266,438. In such devices, in response to a low frequency sequence of rectangular high voltage pulses, the low frequency electrical discharges in a working fluid produce a low frequency electrical arcing leading to a generation of a low frequency thermal plasma resulting in a the low frequency sharp expansion of the working fluid, which is arranged to flow in the desired direction using the check valve means.

The disadvantage of such an approach, as applied to pressure wave generators of a Stirling cryogenic cooler, is poor conversion of electrical energy into the energy of the compressed working fluid through the essential overheating (typically up to 10,000K) occurring inside the core of discharge arc. The associated heat flux generated by this mechanism is then sunk to the environment and rejected from the thermodynamic cycle. Further disadvantages of this approach are intrinsically diminished performance of the Stirling thermodynamic cycle due to the increase of the reject temperature, increase of the heat loading through heat conductivity and radiation, and development of debris contamination the cooler interior.

SUMMARY OF THE INVENTION

The present invention seeks to provide a closed cycle Stirling cryogenic cooler, typically utilizing a noble gas (He, typically) as a working fluid and containing a low frequency pressure wave generator interconnected with a pneumatically driven expander using a flexible transfer line or a conduit.

In one embodiment, the pressure wave generator comprises a sealed gas discharge chamber. A plurality of discharge electrodes protruding through the chamber walls have their active surfaces inside the chamber electrically isolated from the chamber walls and from each other. The discharge electrodes are electrically connected to a high-frequency-pulse, high-voltage power supply allowing easy variation of the carrier frequency, pulse polarity, magnitude and duration, thereby supporting high-frequency non-thermal plasma (glow) discharges leading to a generation of a cold plasmanized gas cloud. Decreasing the power consumption may be obtained by automatically matching the carrier frequency with the acoustic resonant frequency of the gas chamber, or alternatively with the resonant frequency in the electrical network comprising the coil and condenser formed by the discharge electrodes, or alternatively with the frequency of the gas molecules.

The additional low frequency alternating voltage is applied to the discharge electrodes, thus exerting the low frequency electro-hydrodynamic actuation to the cold plasmanized gas cloud, acting in this instance as a "gas piston" imparting the oscillatory momentum to the electrically neutral surrounding gas molecules. This generates low frequency compression waves towards the interior of the gas cavity from which they are supplied to the expander portion of the closed cycle Stirling cryogenic cooler through the flexible transfer line or conduit.

In a second embodiment, the low frequency compression waves inside the cavity are developed by exerting alternating hydro-magnetodynamic (Lorenz) forces on the abovementioned non-thermal plasma cloud developed in a response to the application of the high frequency pulse voltage to the plurality of the discharge electrodes through the region of constricted space using the plurality of the permanent magnets and additional discharge electrodes or electrical coils. From the theory of the magnetodynamics, the direction of permanent magnetic flux produced by the permanent magnets needs to be perpendicular to the direction of the alternating current flowing through the plasma. In response to the forces, the plasma cloud is brought into the oscillatory motion, therefore acting like a "gas piston" causing neutral gas compression by imparting oscillatory momentum to the electrically neutral surrounding gas molecules. This generates low frequency compression waves towards the interior of the gas cavity from which they are supplied to the expander portion of the closed cycle Stirling cryogenic cooler through the flexible transfer line or conduit.

There is thus provided in accordance with an embodiment of the present invention a Stirling cryogenic cooler including an expander unit pneumatically driven by a pressure wave generator including a compression chamber that contains therein a pressurised working fluid, a plurality of electrically isolated discharge electrodes that protrude through walls of the compression chamber, a high frequency pulse voltage supply, to which the discharge electrodes are connected, operative to produce high frequency short voltage pulses resulting in a generation of a cloud of non-thermal plasma which is actuated by a low frequency voltage applied to the discharge electrodes placed inside the compression chamber, so as to impart momentum to neutral gas in the pressure wave generator through collisions between molecules and ions, thus producing pressure oscillations inside the pressure wave generator.

The pressure wave generator may include an electro-hydrodynamic pressure wave generator. Alternatively, the pressure wave generator may include a magneto-hydrodynamic pressure wave generator. The additional low frequency voltage may be applied to additional electrodes placed inside the compression chamber.

BRIEF DESCRIPTION OF THE DRAWINGS

FIGS. 2A and 3A are simplified illustrations of closed cycle Stirling cryogenic coolers, constructed and operative in accordance with embodiments of the present invention;

FIGS. 2B and 3B are simplified illustrations of exemplary shapes of low-frequency magnitude, modulated high-frequency, short voltage pulses $U_1$, for the closed cycle Stirling cryogenic coolers of FIGS. 2A and 3A, respectively; and FIGS. 2C and 3C are simplified illustrations of exemplary shapes of additional low frequency voltages applied to discharge electrodes of the closed cycle Stirling cryogenic coolers of FIGS. 2A and 3A, respectively.

DETAILED DESCRIPTION OF EMBODIMENTS

Figure 1:
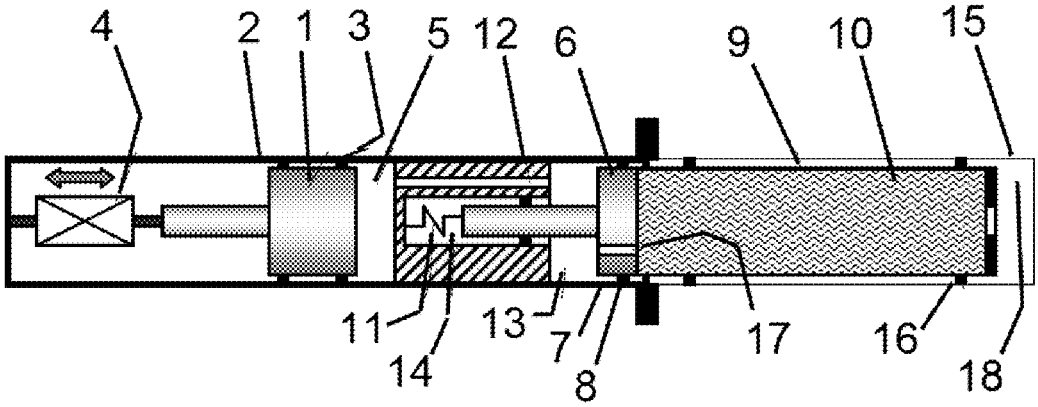
FIG. 1 PRIOR ART
FIG. 1 is a simplified illustration of a prior art Stirling cryogenic cooler.

Reference is now made to FIG. 1, which illustrates a prior art Stirling cryogenic cooler. A compression piston 1 is aligned to slide inside a tightly matched cylinder sleeve 2, against which it is sealed with clearance or contact seals 3. The compressor piston is reciprocatively driven by electromechanical drive 4 (linear voice coil or rotary with crank-slider arrangement) and produces pressure pulses and reciprocal volumetric changes of a working agent (typically pure He) in the compression space or chamber 5. A stepped expander plunger 6 is arranged as to freely slide inside a tightly matched stepped bushing 7, against which it is sealed with clearance or contact seals 8. Attached to the plunger is a regenerator-expander manufactured in the form of a plastic liner 9 filled with stacked fine metal mesh 10. A mechanical spring 11 supports the movable regenerator-expander from the stationary housing. The compressed gas through the conduit 12 is transferred into the driving chamber 13 and pneumatically drives the plunger-expander-regenerator assembly. The resonant frequency of the assembly depends on the moving mass and a spring ratio of a parallel combination of the mechanical spring and gas pillow formed by the protrusion of the plunger tail inside the closed rear volume 14. The desired stroke of the regenerator-expander assembly and 90 deg phase lag vs. the driving pressure oscillations arriving from the compression chamber are controlled by matching the driving frequency to the resonant frequency of the movable plunger-expander-regenerator assembly. The regenerator-expander is arranged to freely reciprocate inside a tightly matched cold finger tube 15 against which it is sealed with clearance or contact seals 16.

The conduit 17 is used for transferring the working fluid from the driving chamber to the expansion space 18 through the regenerator matrix. The expansion of the compressed gas inside the expansion space yields the desired cooling effect which is integrated by the regenerator matrix serving as a heat stop and for pre-cooling the forthcoming gas portion prior to its expansion.

In contrast to the prior art, the present invention provides a split Stirling cryogenic cooler driven by a cold plasma pressure wave generator absent of moving mechanical components (e.g., electromechanical actuator and rubbing piston), and having small bulk, high performance and reliability.

In contrast to the prior art, the present invention makes use of low frequency electro-hydrodynamic and magneto-hydrodynamic actuation of the non-thermal plasma cloud produced by the low powered, high frequency glow discharge inside the sealed tubular chamber thus producing the desired oscillatory pressure pulses and the reciprocal volumetric changes of a working agent in the expansion space of a cold finger.

The electrical discharge in a noble gas, e.g., He, often used as a working fluid in closed cycle Stirling cryogenic coolers, may produce a cloud of ionized gas—plasma. Under particular conditions, such a process may take the form of a glow discharge having low power consumption and generating highly ionized non-thermal plasma, typically at room temperature. The generation of such low-power-consuming, non-thermal glow discharges is based on the use of electrodes placed inside the sealed and gas charged chamber and application of a high frequency sequence of short voltage impulses.

The glow discharge may be also produced by any suitable capacitively and inductively coupled plasma generator. In addition or alternatively, non-thermal plasma may be generated by using RF microwave or laser radiation. The non-thermal plasma cloud serves as a plasmanized "gas piston" which, when oscillatory actuated, imparts oscillatory momentum to the surrounding gas molecules so as to generate the desired oscillatory pressure pulses and the reciprocal volumetric changes of a working agent in the expansion space of a cold finger.

Reference is now made to FIG. 2A, which illustrates a cycle Stirling cryogenic cooler, constructed and operative in accordance with an embodiment of the present invention. This embodiment comprises a pressure wave generator which uses low frequency electro-hydrodynamic actuation.

As opposed to the prior art, in this embodiment a plurality of discharge electrodes 19 are electrically isolated, protrude through the housing wall and are placed inside the compression space (also called chamber) 5. Electrodes 19 are connected to a high frequency pulse power supply 20, producing low-frequency magnitude, modulated high-frequency voltage short pulses $U_1$ (FIG. 2B shows an exemplary shape of the voltage) producing a cloud of non-thermal plasma 21.

The carrier frequency may be matched with the acoustic resonant frequency typical for the compression space, or alternatively may be matched to the resonant frequency of the electrical network comprising the capacitor formed by the electrodes and the auxiliary coil (not shown), or alternatively may be matched with the resonant frequency of the gas molecules.

In accordance with an embodiment of the present invention an additional low frequency alternating voltage $U_2$ (FIG. 2C shows an exemplary shape of the voltage) is applied to the discharge electrodes 19 (auxiliary additional electrodes may be also used), thereby exerting low frequency electro-hydrodynamic actuation to the cold plasma cloud. The cloud acts as a "gas piston" imparting oscillatory momentum to the electrically neutral surrounding gas molecules, thus generating low frequency compression waves supplied to the expander portion of the closed cycle Stirling cryogenic cooler through the conduit 12. The other elements in FIG. 2A are similar to those in FIG. 1, and the expander portion of the cryocooler operates similarly as explained above.

Reference is now made to FIG. 3A, which illustrates a cycle Stirling cryogenic cooler, constructed and operative in accordance with an embodiment of the present invention. This embodiment comprises a pressure wave generator which uses low frequency magneto-hydrodynamic actuation. As opposed to the prior art, in this embodiment the plurality of discharge electrodes 19 are electrically isolated, protrude through the housing wall and are placed inside the compression space 5. They are connected to the high frequency pulse power supply 20, producing high frequency short voltage pulses $U_1$. The carrier frequency, duration and magnitude of the pulses are chosen to maintain the stable non-thermal glow discharge between electrodes 19 thus forming the cloud of non-thermal plasma 21. FIG. 3B shows an exemplary shape of the voltage.

The carrier frequency may be matched with the acoustic resonant frequency typical for the compression space, or alternatively may be matched to the resonant frequency of the electrical network comprising the capacitor formed by the electrodes and the auxiliary coil (not shown), or alternatively may be matched with the resonant frequency of the gas molecules.

A plurality of permanent magnet assemblies 22 provide the magnetic fields that extend in the compression space 5 thus forming the magnetic flux channels for guiding, confining and magnetizing the non-thermal plasma cloud. The plurality of electrodes 23 are electrically isolated, protrude through the housing wall and are placed inside the compression space 5. They are connected to the low frequency pulse power supply 24 producing low frequency voltage pulses $U_2$. The frequency, shape and magnitude of the pulses are chosen to produce the oscillating electrical current inside the magnetized plasma cloud in a direction perpendicular to the direction of the magnetic flux, thus exerting low frequency magneto-hydrodynamic (Lorenz) actuation to the cold plasma cloud. The cloud acts as a "gas piston" imparting oscillatory momentum to the electrically neutral surrounding gas molecules, thus generating low frequency compression waves supplied to the expander portion of the closed cycle Stirling cryogenic cooler through the conduit 12. FIG. 3C shows an exemplary shape of the low frequency voltage. The other elements in FIG. 3A are similar to those in FIG. 1, and the expander portion of the cryocooler operates similarly as explained above.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

What is claimed is:

1. A Stirling cryogenic cooler comprising:

a regenerator-expander unit that comprises a regenerator matrix located between an expansion space and a first side of an expander plunger, and a driving chamber located next to a second side of said plunger opposite to said first side, said plunger and said regenerator matrix arranged to move reciprocatively in a housing;

a pressure wave generator arranged to pneumatically drive said regenerator-expander unit, said pressure wave generator comprising a compression chamber that contains therein non-thermal plasma, a plurality of electrically isolated discharge electrodes that protrude through walls of said compression chamber; and a conduit that forms a passage from said compression chamber to said driving chamber of said regenerator-expander unit;

wherein said pressure wave generator, to which said discharge electrodes are connected, is operative to impart momentum to neutral gas adjacent said non-thermal plasma in said compression chamber through collisions between molecules and ions, thus producing pressure waves inside said compression chamber, wherein said pressure waves flow through said conduit to said driving chamber of said regenerator-expander unit to move said plunger.

2. The Stirling cryogenic cooler according to claim 1, wherein said pressure wave generator comprises an electro-hydrodynamic pressure wave generator.

3. The Stirling cryogenic cooler according to claim 1, wherein said pressure wave generator comprises a magnetohydrodynamic pressure wave generator.

4. The Stirling cryogenic cooler according to claim 1, wherein an additional voltage is applied to additional electrodes placed inside said compression chamber.

5. The Stirling cryogenic cooler according to claim 1, wherein a conduit is formed through said plunger from said driving chamber to said regenerator matrix.

* * * * *